US009416942B2

(12) United States Patent
Choi et al.

(10) Patent No.: US 9,416,942 B2
(45) Date of Patent: Aug. 16, 2016

(54) METHOD FOR MANUFACTURING LIGHT EMITTING KNOB

(71) Applicant: WOOSHIN MS CO., LTD., Changwon-si, Gyeongsangnam-do (KR)

(72) Inventors: Jae Ho Choi, Changwon-si (KR); Seung Won Jung, Changwon-si (KR)

(73) Assignee: WOOSHIN MS CO., LTD. (KR)

( * ) Notice: Subject to any disclaimer, the term of this patent is extended or adjusted under 35 U.S.C. 154(b) by 0 days.

(21) Appl. No.: 14/958,091

(22) Filed: Dec. 3, 2015

(65) Prior Publication Data

US 2016/0201878 A1 Jul. 14, 2016

(30) Foreign Application Priority Data

Jan. 14, 2015 (KR) ..... 10-2015-0006927

(51) Int. Cl.

*H01H 11/00* (2006.01)
*H01H 9/18* (2006.01)
*F21V 11/00* (2015.01)

(52) U.S. Cl.

CPC ..... *F21V 11/00* (2013.01); *Y10T 29/4998* (2015.01); *Y10T 29/49844* (2015.01); *Y10T 29/49885* (2015.01); *Y10T 29/49906* (2015.01); *Y10T 29/49982* (2015.01)

(58) Field of Classification Search

CPC ..... F21V 11/00; Y10T 29/49906; Y10T 29/49885; Y10T 29/49844; Y10T 29/49982; Y10T 29/4998

See application file for complete search history.

(56) References Cited

U.S. PATENT DOCUMENTS 5,036,440 A * 7/1991 Takii ..... F21V 9/08 200/314
5,878,870 A * 3/1999 Ohtaki ..... H01H 13/023 200/313
2015/0092387 A1* 4/2015 Na ..... H01H 13/14 362/23.04

FOREIGN PATENT DOCUMENTS

KR 10-1210906 B1 12/2012
KR 10-1370256 B1 3/2014
KR 10-1412781 B1 7/2014

* cited by examiner

*Primary Examiner* — John C Hong
(74) *Attorney, Agent, or Firm* — Park & Associates IP Law, P. C.

(57) ABSTRACT

The present invention relates to a method for manufacturing a light emitting knob based on a novel process that is capable of preventing a letter that is separated from a light blocking metal plate at a display window forming step and a surface treatment step from being separated from a resin layer irrespective of the shape or the type of the letter, which constitutes a light emitting display window, thereby considerably reducing a defect rate. The method includes a metal plate processing step, a display groove forming step, a resin layer coupling step, and a display window forming step.

7 Claims, 11 Drawing Sheets

METHOD FOR MANUFACTURING LIGHT EMITTING KNOB

REFERENCE TO RELATED APPLICATIONS

This application claims the priority benefit of Korean Patent Application No. 10-2015-0006927 filed on Jan. 14, 2015, the entire contents of which are incorporated herein by reference.

FIELD OF THE INVENTION

The present invention relates to a method for manufacturing a light emitting knob that emits light emitted from a light emitting device outward through a letter or symbol type light emitting display window, thereby improving visibility.

BACKGROUND OF THE INVENTION

In general, a knob, which has the same dictionary definition as a protruding handle, is a button that is configured to display or control a vehicle or an electronic product. Knobs may have various shapes, structures, and functions. For example, knobs are classified into a display type knob, such as a change knob of a transmission gear of a vehicle, a push type knob, such as a start button of a vehicle, or a rotary type knob, such as a volume adjustment knob of an audio system.

Conventionally, a synthetic resin was simply molded in order to manufacture the knob. In recent years, knobs having luxurious and aesthetically pleasing appearances have been proposed with increasing interest in the design of knobs. For example, a light emitting adjustment knob is disclosed in Korean Registered Patent Publication No. 10-1210906. As shown in FIGS. 1 and 2, a light emitting knob 1 includes a light blocking metal plate 10 having a light emitting display window 11 and a resin layer 20, made of a light-transmissive synthetic resin, coupled to the lower surface of the light blocking metal plate 10.

The resin layer 20 is coupled to the lower part of the light blocking metal plate 10 by bonding or by insert injection molding. In addition, referring to FIG. 2, a light emitting device 30 is installed under the resin layer 20 to display a predetermined message, such as "ENGINE START STOP," outward through the light emitting display window 11 of the light blocking metal plate 10 in a light emitting fashion.

A method for manufacturing the conventional light emitting knob as described above will be described with reference to FIGS. 3 and 4. The method for manufacturing the conventional light emitting knob includes a metal plate processing step (S10) of processing a light blocking metal plate 10 such that the upper part of the light blocking metal plate is closed and the lower part of the light blocking metal plate is open, a resin layer coupling step (S20) of coupling a resin layer 20, which is made of a light-transmissive synthetic resin, to the inner side of the lower part of the light blocking metal plate 10, a display window forming step (S30) of forming a light emitting display window 11 in the upper surface of the light blocking metal plate 10 by carving, a surface treatment step (S40) of treating the upper surface of the light blocking metal plate 10, in which the light emitting display window 11 is formed, and a coating step (S50) of coating the treated upper surface of the light blocking metal plate 10.

In the method for manufacturing the conventional light emitting knob, as shown in FIG. 5, letters, such as E, N, G, I, N, S, and T, the start and the end of a cutoff line of each of which are attached to the light blocking metal plate 10, of "ENGINE START STOP," which is the message, displayed through the light emitting display window 11, which is widely used, are not separated from the resin layer 20. However, the inner portions of letters, such as A, R, O, and P, which are separated from the light blocking metal plate 10 with the result that only the bottom surfaces of the letters are attached to the resin layer 20, i.e. "Δ" of A, "D" of R and P, and "O" of O, are easily separated from the resin layer 20 when light emitting display window 11 is formed by carving at the display window forming step (S30) and when the upper surface of the light blocking metal plate 10 is treated at the surface treatment step (S40), whereby a defect rate is increased.

SUMMARY OF THE INVENTION

The present invention has been made to solve the above problems, and it is an object of the present invention to provide a method for manufacturing a light emitting knob based on a novel process that is capable of preventing a letter that is separated from a light blocking metal plate at a display window forming step and a surface treatment step from being separated from a resin layer irrespective of the shape or the type of the letter, which constitutes a light emitting display window, thereby considerably reducing a defect rate.

Other objects, specific advantages, and novel features of the present invention will become apparent from the following description of embodiments given in conjunction with the accompanying drawing.

In order to accomplish the above objects, a method for manufacturing a light emitting knob according to the present invention includes a metal plate processing step of processing a light blocking metal plate such that the upper part of the light blocking metal plate is closed and the lower part of the light blocking metal plate is open, a display groove forming step of forming a light emitting display groove in the inner surface of the upper side of the light blocking metal plate, a resin layer coupling step of forming a resin layer, which is made of a synthetic resin, by insert injection molding using the light blocking metal plate as an insert and coupling the light blocking metal plate to the resin layer such that the resin layer is coupled to the inner side of the lower part of the light blocking metal plate up to the light emitting display groove, and a display window forming step of evenly cutting the upper surface of the light blocking metal plate such that the resin layer coupled into the light emitting display groove is exposed from the upper surface of the light blocking metal plate to form a light emitting display window.

In addition, the metal plate processing step may include processing a plate-shaped metal material by pressing to manufacture the light blocking metal plate.

In addition, the method according to the present invention may further include a surface treatment step of treating the upper surface of the light blocking metal plate, in which the light emitting display window is formed.

In addition, the surface treatment step may include forming hairlines on the upper surface of the light blocking metal plate or spinning the upper surface of the light blocking metal plate.

In addition, the method according to the present invention may further include a coating step of coating the upper surface of the light blocking metal plate.

In addition, the coating step may include coating the upper surface of the light blocking metal plate with hard urethane.

The method for manufacturing the light emitting knob according to the present invention has the following effects. First, the light emitting display groove is formed in the lower surface of the light blocking metal plate at the display groove forming step, and then the resin layer coupling step is carried out such that the lower surface and the lateral surface of a letter, which will be separated from the light blocking metal plate, are securely coupled into the resin layer.

Second, the upper surface of the light blocking metal plate is evenly cut at the display window forming step in order to form the light emitting display window. Consequently, it is possible to prevent the letter that is separated from the light blocking metal plate at the display window forming step and the surface treatment step from being separated from the resin layer irrespective of the shape or the type of the letter, thereby considerably reducing a defect rate.

DETAILED DESCRIPTION OF THE INVENTION

Hereinafter, an exemplary embodiment of a method for manufacturing a light emitting knob according to the present invention will be described in detail with reference to the accompanying drawings.

Figure 10:
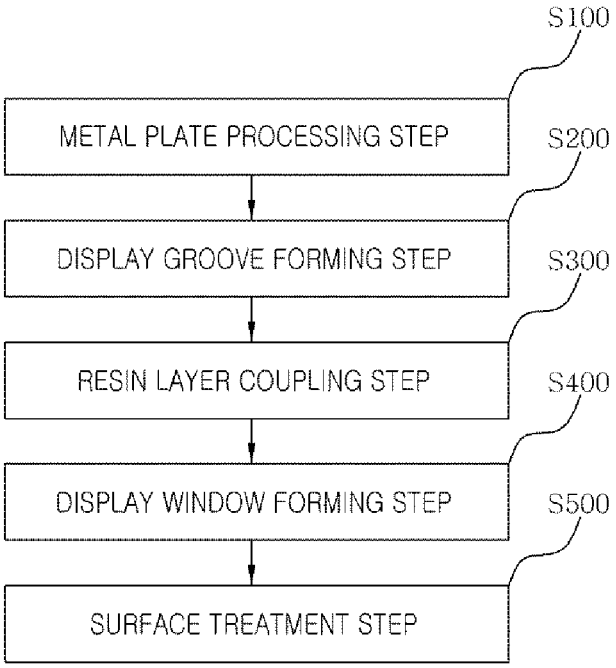
FIG. 10 is a flowchart showing a second embodiment of a method for manufacturing a light emitting knob according to the present invention.
Figure 11:
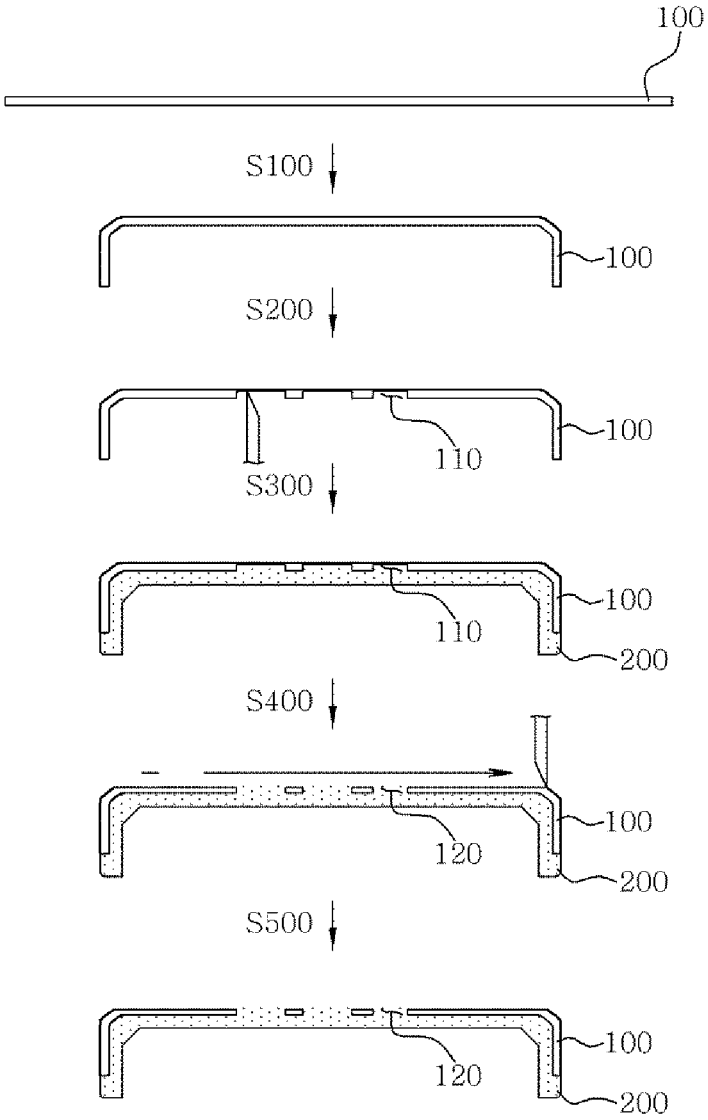
FIG. 11 is a side sectional view showing, step by step, a process for manufacturing a light emitting knob in accordance with the flowchart of the embodiment shown in FIG. 10.
Figure 12:
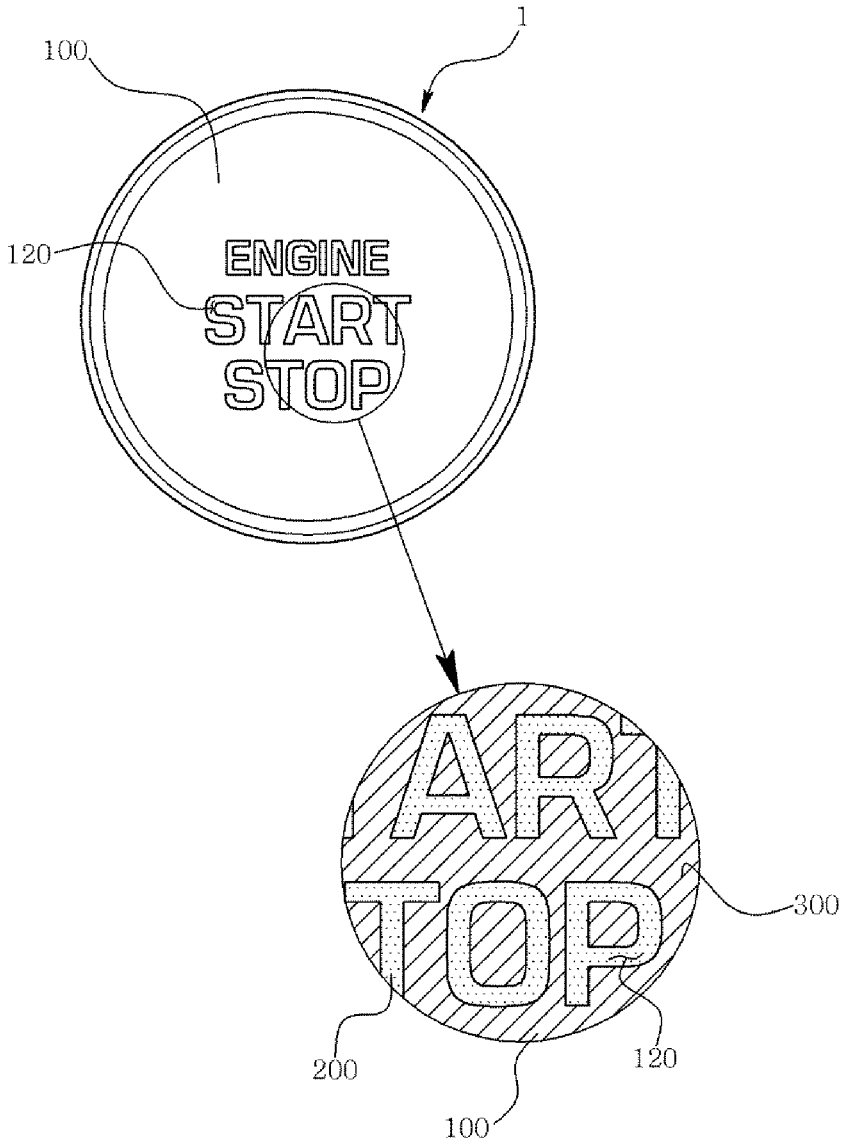
FIG. 12 is a front view showing a light emitting knob that is manufactured in accordance with the embodiment shown in FIGS. 10 and 11.
Figure 13:
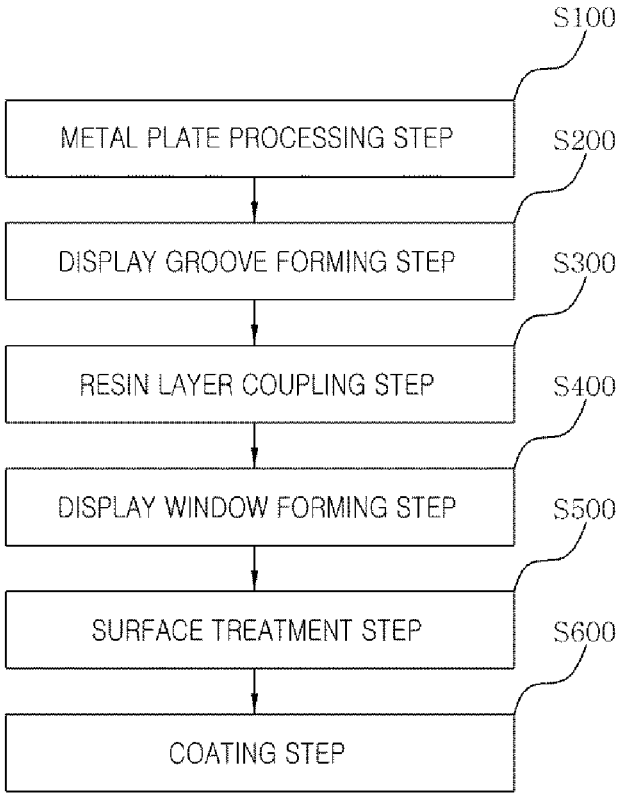
FIG. 13 is a flowchart showing a third embodiment of a method for manufacturing a light emitting knob according to the present invention.
Figure 14:
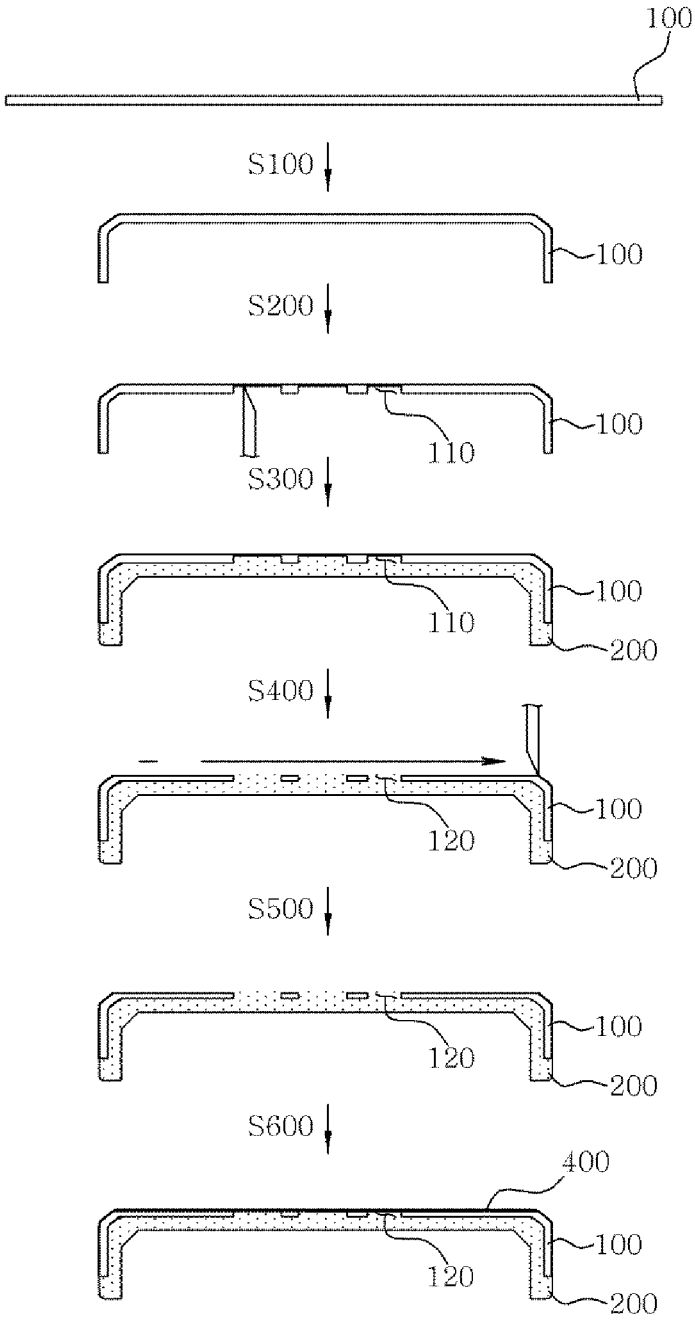
FIG. 14 is a side sectional view showing, step by step, a process for manufacturing a light emitting knob in accordance with the flowchart of the embodiment shown in FIG. 13.

As shown in FIGS. 6 to 9, the method for manufacturing the light emitting knob according to the present invention may include a metal plate processing step (S100), a display groove forming step (S200), a resin layer coupling step (S300), and a display window forming step (S400). As shown in FIGS. 10 to 12, the method for manufacturing the light emitting knob according to the present invention may further include a surface treatment step (S500). As shown in FIGS. 13 and 14, the method for manufacturing the light emitting knob according to the present invention may further include a coating step (S600).

Figure 1:
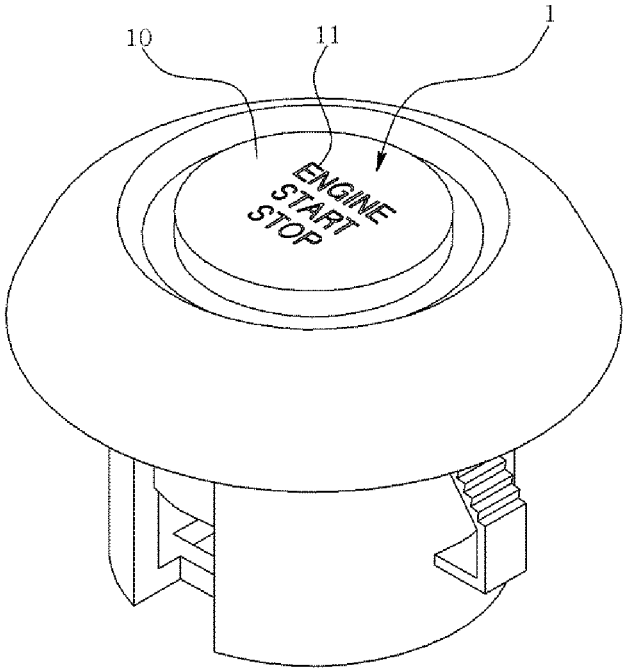
FIG. 1 (Related Art)
FIG. 1 is a perspective view showing a general light emitting knob.
Figure 2:
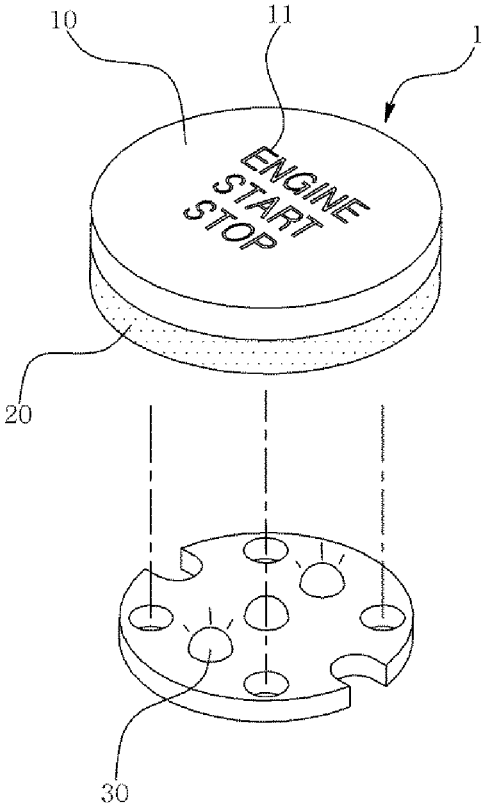
FIG. 2 (Related Art)
FIG. 2 is an exploded perspective view of the light emitting knob in the embodiment shown in FIG. 1.
Figure 3:
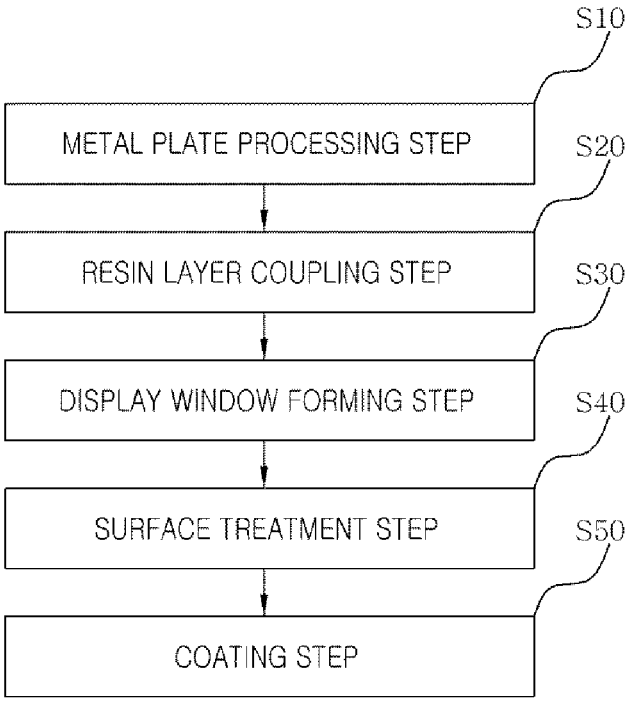
FIG. 3 (Related Art)
FIG. 3 is a flowchart showing a method for manufacturing a conventional light emitting knob.
Figure 4:
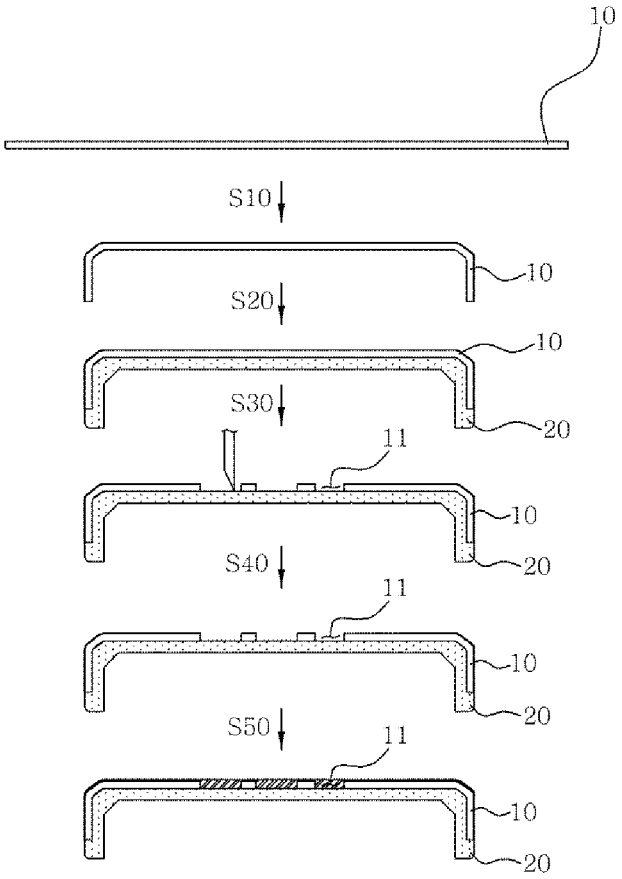
FIG. 4 (Related Art)
FIG. 4 is a side sectional view showing, step by step, a process for manufacturing a light emitting knob in accordance with the flowchart of the embodiment shown in FIG. 3.
Figure 5:
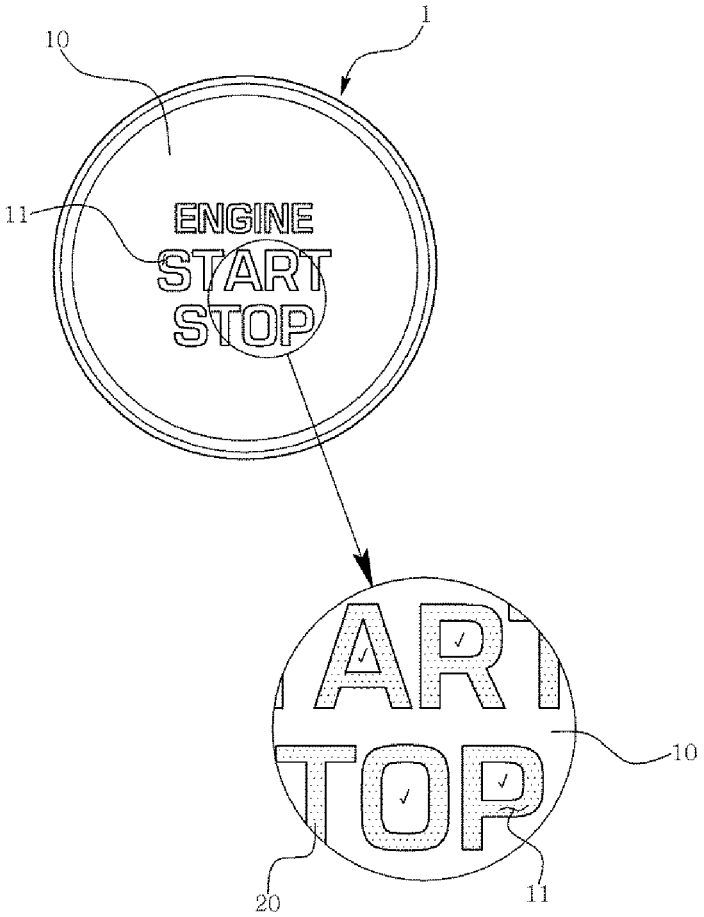
FIG. 5 (Related Art)
FIG. 5 is a front view showing a light emitting knob that is manufactured in accordance with the embodiment shown in FIGS. 3 and 4.
Figure 6:
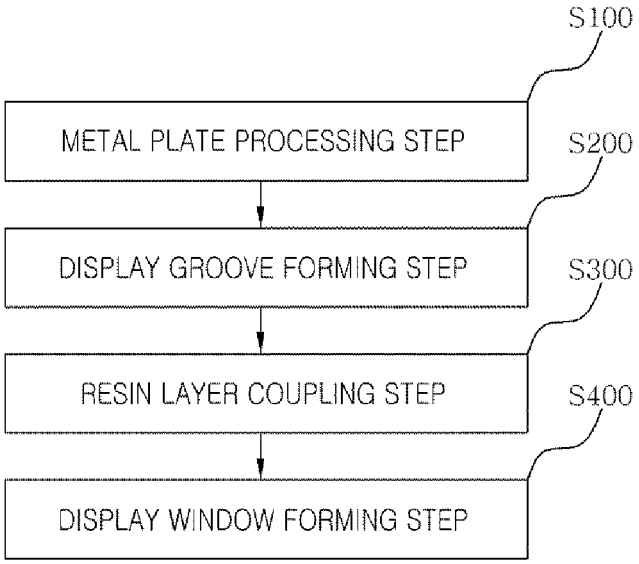
FIG. 6 is a flowchart showing a first embodiment of a method for manufacturing a light emitting knob according to the present invention.
Figure 7:
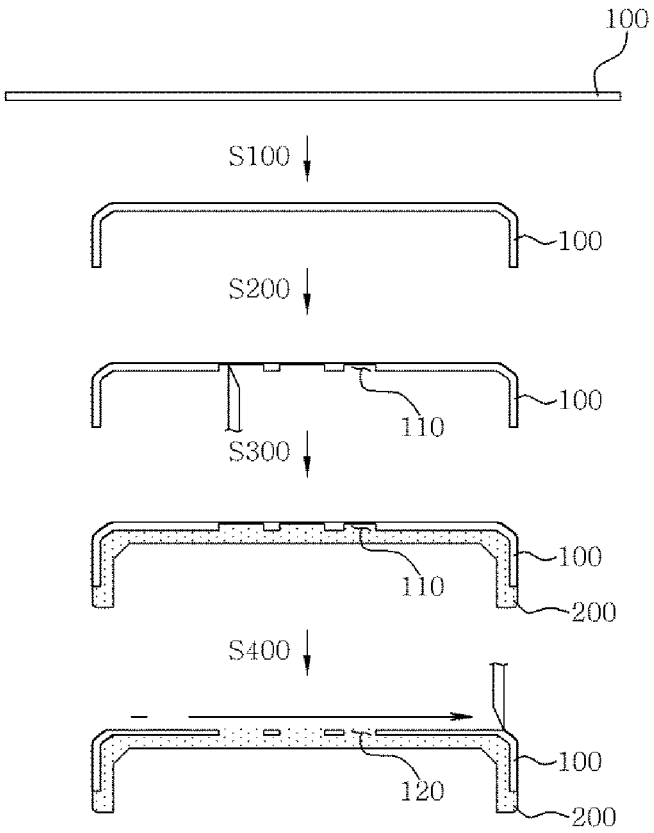
FIG. 7 is a side sectional view showing a process for manufacturing a light emitting knob per step in accordance with the flowchart of the embodiment shown in FIG. 6.

At the metal plate processing step (S100), as shown in FIGS. 6 and 7, a light blocking metal plate 100 is processed such that the upper part of the light blocking metal plate 100 is closed and the lower part of the light blocking metal plate 100 is open. The light blocking metal plate 100 is made of a plate-shaped metal material. As compared with a conventional synthetic resin, the light blocking metal plate 100 has an aesthetically pleasing appearance due to the luxurious characteristics of metal. The light blocking metal plate 100 has various shapes based on the function and type of the light emitting knob. As shown in FIG. 2, the upper part of the light blocking metal plate 100 is closed and the lower part of the light blocking metal plate 100 is open such that the light blocking metal plate 100 blocks light from the light emitting device 30, which emits light under the light blocking metal plate 100, and such that the lower part of the light blocking metal plate 100 is coupled to the light emitting device 30. The light blocking metal plate 100 may be processed using various processing methods, such as cutting, casting, and injection molding, such that the upper part of the light blocking metal plate 100 is closed and the lower part of the light blocking metal plate 100 is open. As shown in FIG. 7, however, a plate-shaped metal material may be processed by pressing to manufacture the light blocking metal plate 100, which is most suitable for mass production, considering that the light blocking metal plate 100 is made of a plate-shaped material.

Figure 8:
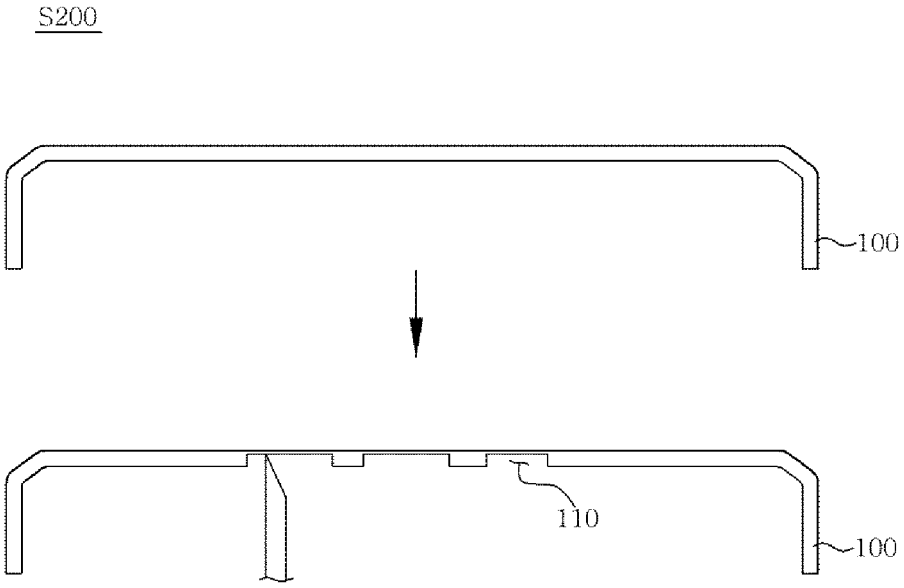
FIG. 8 is a side sectional view of a principal part showing a process for manufacturing a light emitting knob at a display groove forming step in the embodiment shown in FIG. 7.

At the display groove forming step (S200), as shown in FIGS. 6 to 8, a light emitting display groove 110 is formed in the inner surface of the upper side of the light blocking metal plate 100. In a case in which the light blocking metal plate 100 is configured such that the upper part of the light blocking metal plate 100 is closed and the lower part of the light blocking metal plate 100 is open, as shown in FIGS. 6 to 8, the light blocking metal plate 100 has a '[' shape, in which the lower part of the light blocking metal plate 100 is open when viewed in side section. The light emitting display groove 110 is formed in the upper surface of the inner side of the light blocking metal plate 100 or in the inner surface of the upper side of the light blocking metal plate 100 such that the light emitting display groove 110 has the same shape as a letter or a symbol of a light emitting display window 120, which will be described hereinafter. As shown in FIGS. 7 and 8, carving may be used to form the light emitting display groove 110 in the inner surface of the upper side of the light blocking metal plate 100. Alternatively, various other processing methods, such as pressing, punching, and chemical hatching, may be used to form the light emitting display groove 110 in the inner surface of the upper side of the light blocking metal plate 100. Any processing methods may be used as long as, at the display groove forming step (S200), the light emitting display groove 110 is formed in the inner surface of the upper side of the light blocking metal plate 100 such that the light emitting display groove 110 has the same shape as the light emitting display window 120, which will be described hereinafter.

Meanwhile, it may seem that the display groove forming step (S200) is carried out after the metal plate processing step (S100) considering the order of the reference symbols or the sequence of the flowchart shown in the drawings. However, the sequence in which the metal plate processing step (S100) and the display groove forming step (S200) are carried out is not particularly restricted. That is, at the display groove forming step (S200), the light emitting display groove 110 may be formed in advance in a portion of the plate-shaped metal material which will become the inner surface of the upper side of the light blocking metal plate 100 at the metal plate processing step (S100), and then the metal plate processing step (S100) may be carried out. Alternatively, the metal plate processing step (S100) and the display groove forming step (S200) may be simultaneously carried out such that the light blocking metal plate 100 is processed by pressing simultaneously when the light emitting display groove 110 is formed.

At the resin layer coupling step (S300), a resin layer 200, which is made of a synthetic resin, is coupled to the inner side of the lower part of the light blocking metal plate 100. Since the resin layer 200 is made of a light transmissive synthetic resin, light emitted from the light emitting device 30 may be transmitted through the resin layer 200 such that the light reaches the light blocking metal plate 100. Although not shown in the drawings, the resin layer 200 may be provided at the lower part thereof with a bracket, a protrusion, or a protruding recess such that the resin layer 200 can be coupled with another member. In a case in which the resin layer 200 is coupled to the inner side of the lower part of the light blocking metal plate 100, the resin layer 200 may be manufactured in advance so as to have a shape in which the resin layer 200 can be inserted into and fitted in the light blocking metal plate 100, and may then be coupled to the light blocking metal plate 100 by bonding. Alternatively, the resin layer 200 may be formed by insert injection molding using the light blocking metal plate 100 as an insert such that the light blocking metal plate 100 is coupled to the resin layer 200.

Figure 9:
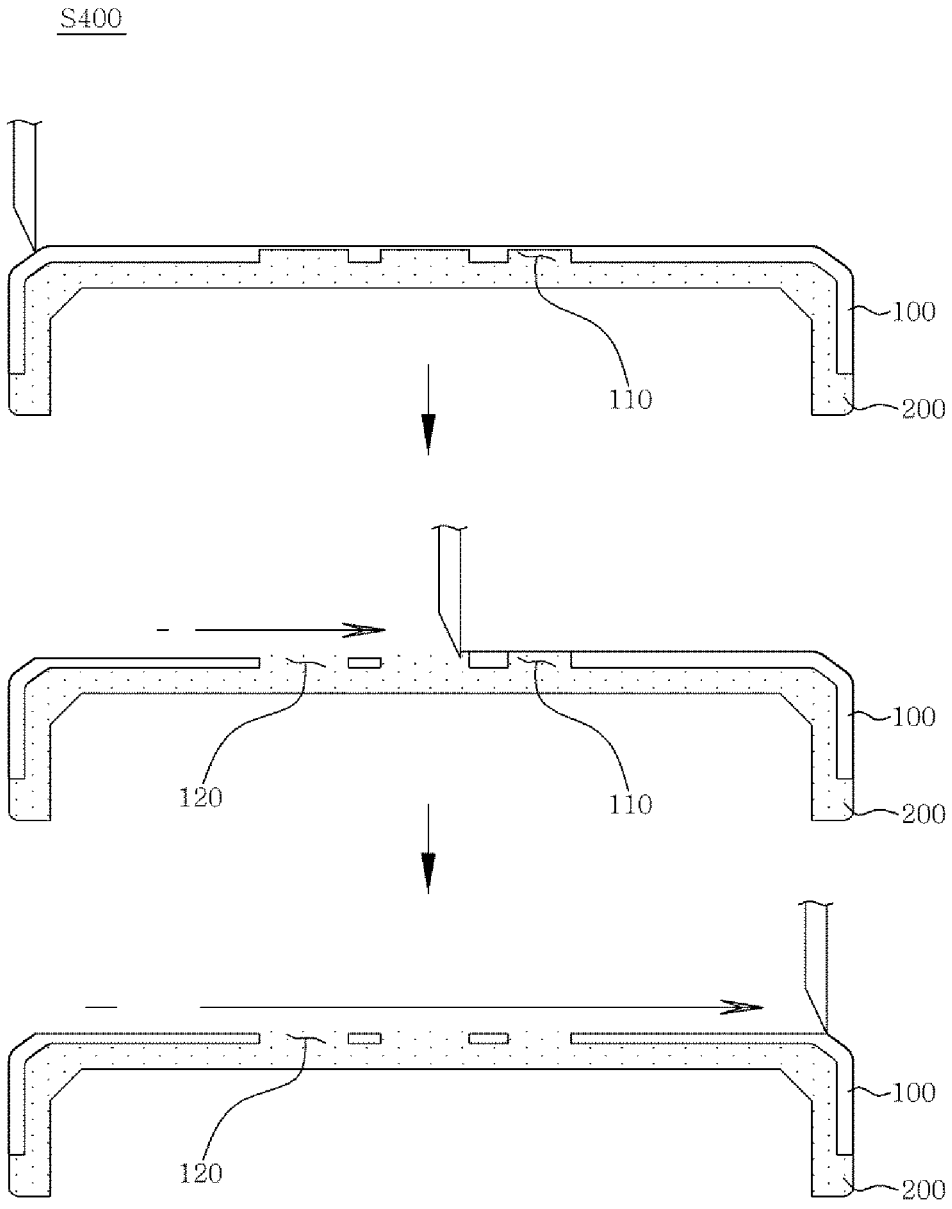
FIG. 9 is a side sectional view of a principal part showing a process for manufacturing a light emitting knob at a display window forming step in the embodiment shown in FIG. 7.

At the display window forming step (S400), as shown in FIGS. 6, 7, and 9, the upper surface of the light blocking metal plate 100 is evenly cut such that the light emitting display groove 110 is exposed from the upper surface of the light blocking metal plate 100 to form a light emitting display window 120. That is, after the light emitting display groove 110 is formed at the display groove forming step (S200) and the resin layer 200 is coupled to the light blocking metal plate 100, light that is emitted from the light emitting device 30 and reaches the light blocking metal plate 100 cannot be emitted upward since the upper surface of the light emitting display groove 110 is closed.

In a case in which the upper surface of the light blocking metal plate 100 is evenly cut up to the upper end of the light emitting display groove 110, the light emitting display groove 110 is exposed upward with the result that the groove is becomes a hole or an open window, which constitutes the light emitting display window 120.

In the method for manufacturing the light emitting knob according to the present invention, as described above, the light emitting display groove 110 is formed in the lower surface of the light blocking metal plate 100 at the display groove forming step (S200), and then the resin layer coupling step (S300) is carried out such that the lower surface and the lateral surface of a letter, which will be separated from the light blocking metal plate 100, are securely coupled into the resin layer 200. Subsequently, at the display window forming step (S400), the upper surface of the light blocking metal plate 100 is evenly cut in order to form the light emitting display window 120. Consequently, it is possible to prevent the letter that is separated from the light blocking metal plate 100 at the display window forming step (S400) and a surface treatment step (S500), which will be described hereinafter, from being separated from the resin layer 200 irrespective of the shape or the type of the letter, thereby considerably reducing a defect rate.

At the surface treatment step (S500), as shown in FIGS. 10 and 11, the upper surface of the light blocking metal plate 100, in which the light emitting display window 120 is formed, is treated. Surface treatment includes plating or painting performed on the surface of a material such that the material exhibits high corrosion resistance, smoothness, and hardness. As shown in FIG. 12, surface treatment further includes forming hairlines 300 on the upper surface of the light blocking metal plate 100 or spinning the upper surface of the light blocking metal plate 100. The letter that is separated from the light blocking metal plate 100 at the surface treatment step (S500) may be easily separated from the resin layer 200. In the method for manufacturing the light emitting knob according to the present invention, as described above, the lower surface and the lateral surface of the letter that is separated from the light blocking metal plate 100 is securely coupled into the resin layer 200 in a buried state, whereby it is possible to prevent the letter from being separated from the resin layer 200.

At the coating step (S600), as shown in FIGS. 13 and 14, the upper surface of the light blocking metal plate 100 is coated. Coating includes putting a thin film of paraffin, rubber resin, or a chemical material on the surface of a material. In the present invention, the surface of the light blocking metal plate 100 is coated with hard urethane 400. In a case in which liquid urethane is mixed with a pigment having various colors, the hard urethane 400 is formed in a semi-transparent state. The upper surface of the light blocking metal plate 100 is coated with the hard urethane 400, and is then dried. As a result, it is possible to improve the visibility of light emitted through the light emitting display window 120. In addition, in a case in which the light blocking metal plate 100 is coated with the hard urethane 400, it is possible to avoid leaving fingerprints on the upper surface of the light blocking metal plate 100 and to provide the light blocking metal plate 100 with an aesthetically pleasing appearance.

It must not be interpreted that the preferred embodiments of the present invention, which have been described above and shown in the drawings, define the technical idea of the present invention. The scope of protection of the present invention is limited by what is claimed in the claims, and various modifications and variations of the technical idea of the present invention can be made by those skilled in the art to which the present invention pertains. Therefore, such modifications and variations will fall into the scope of protection of the present invention as far as they are obvious to those skilled in the art.

DESCRIPTION OF REFERENCE SYMBOLS

1: Light emitting knob
100: Light blocking metal plate
110: Light emitting display groove
120: Light emitting display window
200: Resin layer
300: Hairlines
400: Coating layer
S100: Metal plate processing step
S200: Display groove forming step
S300: Resin layer coupling step
S400: Display window forming step
S500: Surface treatment step
S600: Coating step

What is claimed is:

1. A method for manufacturing a light emitting knob comprising:

a metal plate processing step of forming a light blocking metal plate in a cap shape including a closed upper part and a lower part having an upwardly recessed surface area;

a display groove forming step of forming a light emitting display groove in the upwardly recessed surface area of the light blocking metal plate;

a resin layer coupling step of forming to couple a resin layer to the upwardly recessed surface area of the light blocking metal plate such that the light emitting display groove is filled and coupled with the resin layer; and a display window forming step of cutting an upper surface of the light blocking metal plate such that the resin layer coupled into the light emitting display groove is exposed from an upper surface of the light blocking metal plate to form a light emitting display window.

2. The method according to claim 1, wherein in the metal plate processing step, a plate-shaped metal material is pressed to form the light blocking metal plate into the cap shape.

3. The method according to claim 1, further comprising a surface treatment step of treating the upper surface of the light blocking metal plate, in which the light emitting display window is formed.

4. The method according to claim 3, wherein the surface treatment step comprises forming hairlines on the upper surface of the light blocking metal plate or spinning the upper surface of the light blocking metal plate.

5. The method according to claim 3, further comprising a coating step of coating the upper surface of the light blocking metal plate.

6. The method according to claim 5, wherein the coating step comprises coating the upper surface of the light blocking metal plate with hard urethane.

7. The method according to claim 1, wherein the resin layer coupling step is performed by insert injection molding using the light blocking metal plate as an insert and coupling the light blocking metal plate to the resin layer.

* * * * *